US006000063A

United States Patent [19]

Sullivan

[11] Patent Number: 6,000,063

[45] Date of Patent: Dec. 14, 1999

[54] NOVELTY SPORTS HAT WITH THREE-DIMENSIONAL TEAM INSIGNIA

[76] Inventor: Michael J. Sullivan, 25 Gentile Ct., Staten Island, N.Y. 10312

[21] Appl. No.: 08/970,484

[22] Filed: Nov. 14, 1997

[51] Int. Cl.[6] ..... A42B 1/24

[52] U.S. Cl. ..... 2/209.13; 2/244; 40/329; D2/872; D2/895

[58] Field of Search ..... 2/209.13, 244, 2/246; 40/329; D2/866, 869, 872, 895

[56] References Cited

U.S. PATENT DOCUMENTS

| | | | |
|---|---|---|---|
| D. 69,758 | 3/1926 | Jenkins | D2/869 |
| D. 359,159 | 6/1995 | Barker | D2/872 |
| D. 374,462 | 10/1996 | Tyler et al. | D20/27 |
| D. 406,190 | 3/1999 | Hagerty | D2/895 |
| 4,268,918 | 5/1981 | Lee | 2/199 |
| 4,601,070 | 7/1986 | Sargentini | 2/209 |
| 4,776,043 | 10/1988 | Coleman | 2/209.13 |
| 5,348,510 | 9/1994 | DuPont et al. | 2/209.13 |
| 5,454,120 | 10/1995 | Rowlands | 2/195.1 |
| 5,457,821 | 10/1995 | Kiefer | 2/195.1 |
| 5,561,864 | 10/1996 | Demars | 2/209.13 |
| 5,781,934 | 7/1998 | Pauley, Jr. | 2/209.13 |

*Primary Examiner*—Diana Oleksa
*Attorney, Agent, or Firm*—Cobrin & Gittes

[57] ABSTRACT

A sports insignia cap that includes a crown element forming a dome shape adapted to be worn atop a person's head, a spongy, flexible form having a configuration indicative of a sports team insignia, a fabric enveloping said flexible form and providing decoration in conformance with being indicative of the sports team insignia, and a fastener that fastens the crown element to at least one of the flexible form and the fabric.

11 Claims, 4 Drawing Sheets

NOVELTY SPORTS HAT WITH THREE-DIMENSIONAL TEAM INSIGNIA

BACKGROUND OF THE INVENTION

1. Field of the Invention

The invention relates to a novelty sports hat that has a three-dimensional configuration indicative of a sports team insignia.

2. Discussion of Related Art

Logo sports caps are known from U.S. Pat. No. Des. 359,159 that show a sports logo sewn onto the front side of the cap. A ball cap with replaceable pennant panels is known from U.S. Pat. No. 5,454,120.

While the conventional sports logo cap and ball cap with replaceable pennant panels seem suitable for sports fans who want their hats to designate their favorite teams, the two-dimensional representation of the logo does not stand out when viewed from a distance and may not be easily distinguishable from hats with two-dimensional representation of logos of other teams when viewed from afar.

Conventional novelty hats include disclosure of those that use three-dimensional configurations that are either humorous (e.g., U.S. Pat. No. 4,601,070 that gives the appearance of a ski pole passing through the wearer's head or U.S. Pat. No. 5,457,821 that simulates a fried egg) or cute (U.S. Pat. No. 4,268,918 that show animals whose limbs or extremities may be moved with a rope pull, e.g., a skunk, a bird, a turtle and a dog head).

It is desirable to combine features of novelty hats and sports logo hats in such a manner that the sports logo is easily recognized from a distance and readily distinguishable from other sports logos of other hats. It is further desirable to manufacture the sports logo configuration in three-dimensional form so that the configuration does not cause injury to others while the hat is worn.

SUMMARY OF THE INVENTION

One aspect of the invention resides in a sports insignia cap that includes a crown element with a rim that is adjustable to fit various head sizes, a forwardly extending visor that projects forwardly from the rim of the crown element, and a three dimensional configuration of a sports team insignia secured to the crown element. Preferably, the configuration is divided into components with each component attached to the crown element at different locations that are spaced apart from each other. Each component preferably includes a foam sponge or plastic lightweight mold type for (Bear, Eagle, Redskin, Viking, Bengal, etc.) construction enveloped by fabric to resemble a portion of the three dimensional configuration of the sports team insignia.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
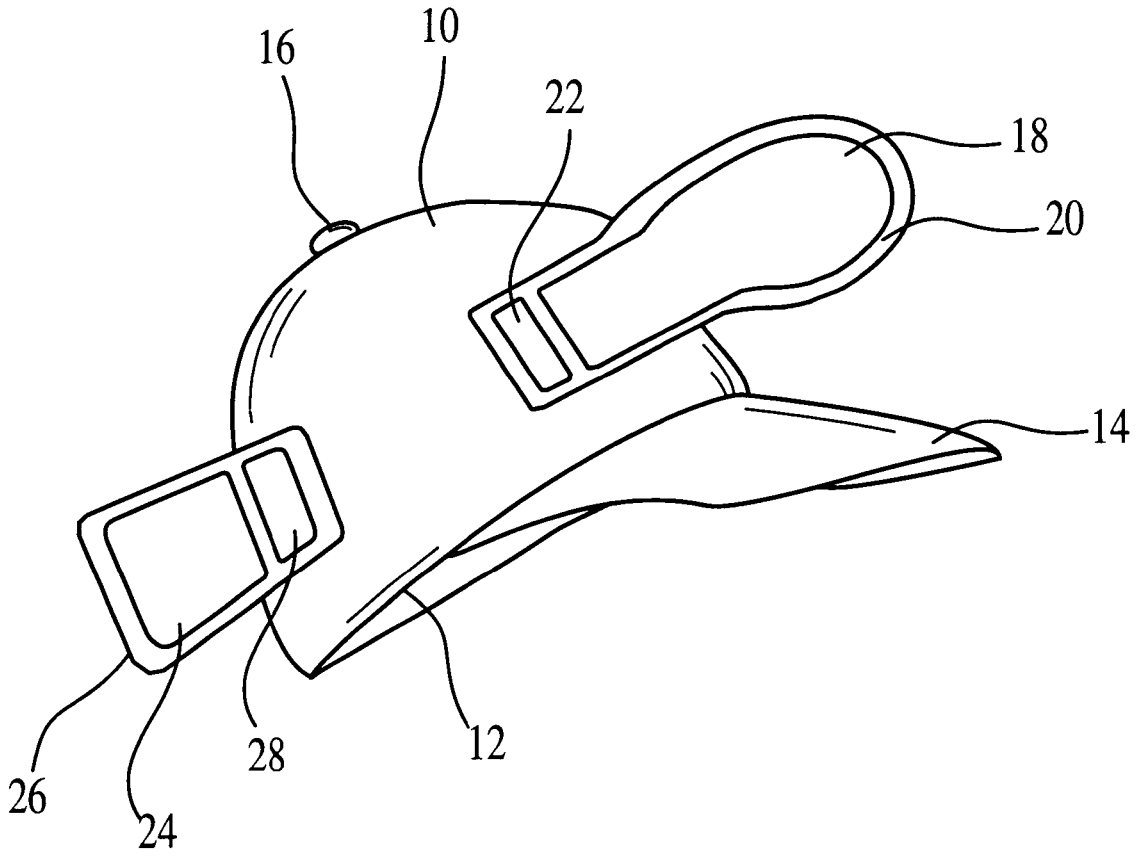
FIG. 1 is a schematic representation of the invention, revealing the internal construction of a three dimensional configuration of a sports team insignia attached to a cap.
Figure 2:
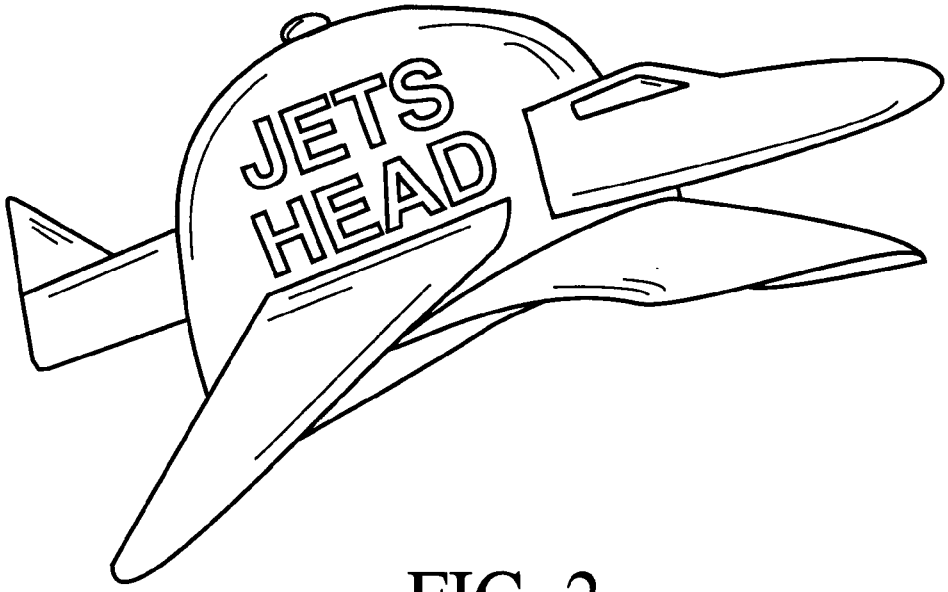
FIGS. 2–7 are perspective views of different embodiments of the invention, each representing a different sports team insignia three dimensionally. For those views that show a wing, horn, horseshoe, or feather projecting from one side of the cap, there is a mirror image counterpart projecting from the opposite side. Also, to the extent that the views show one side of each component of a configuration as projecting from the front and from the rear of the cap, the other side of each of component is symmetric. The wings, and horseshoe that are seen in some views are substantially flat when viewed from the top or bottom, but all other configurations are symmetric about their longitudinal axes.
Figure 3:
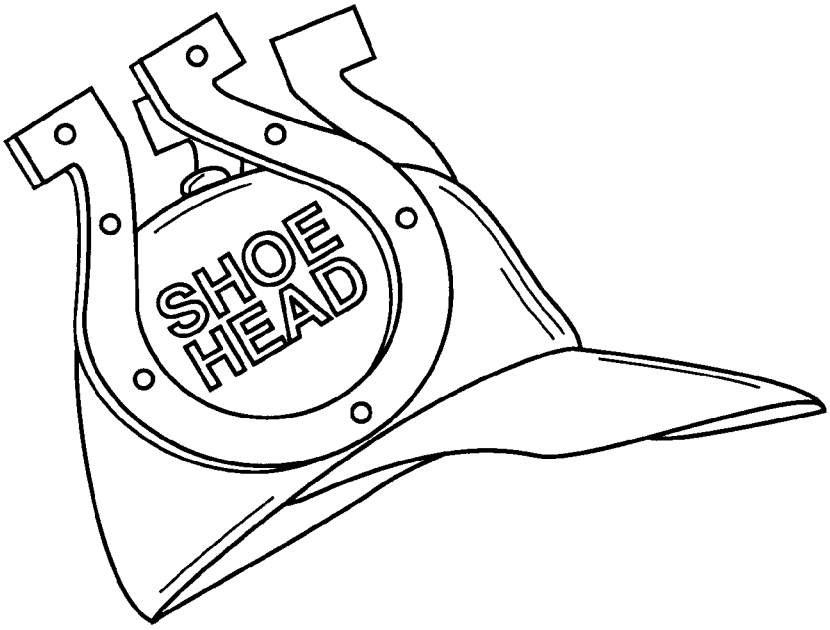
Figure 4:
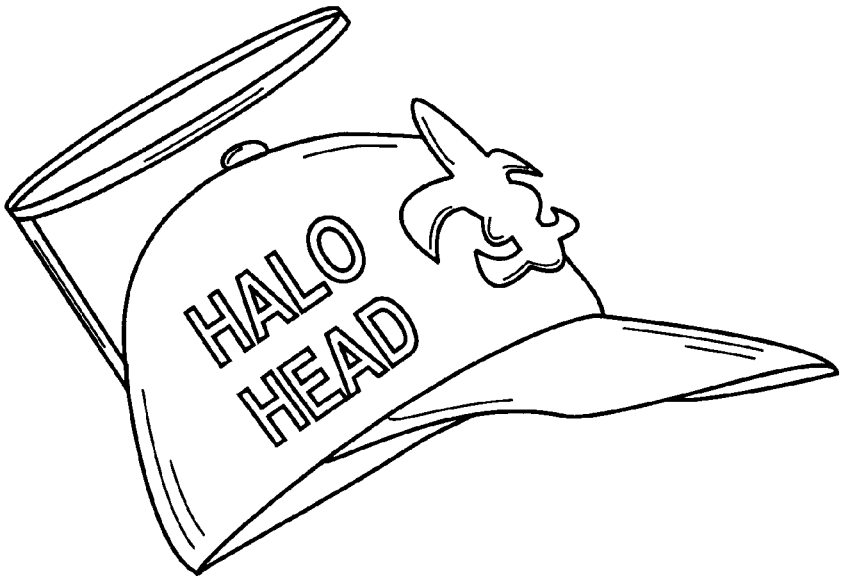
Figure 5:
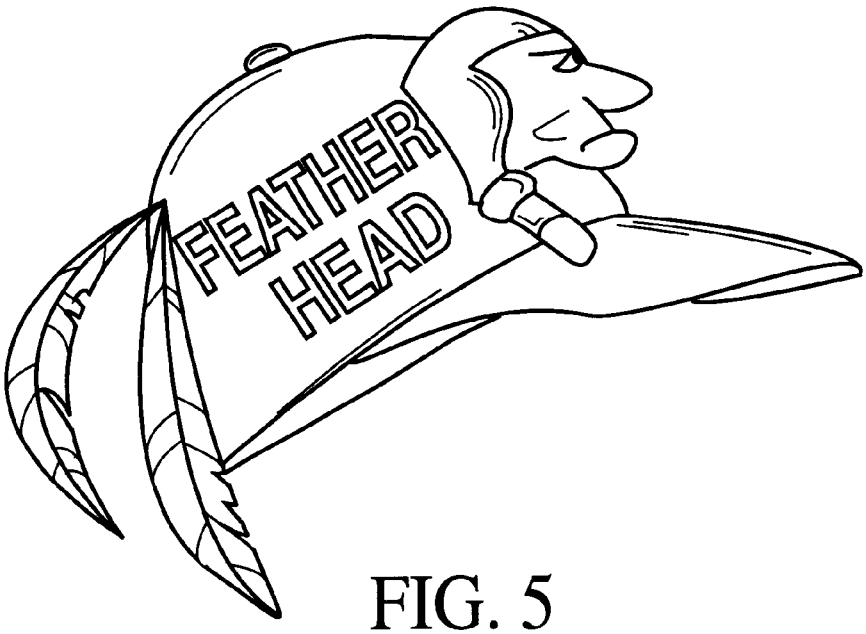
Figure 6:
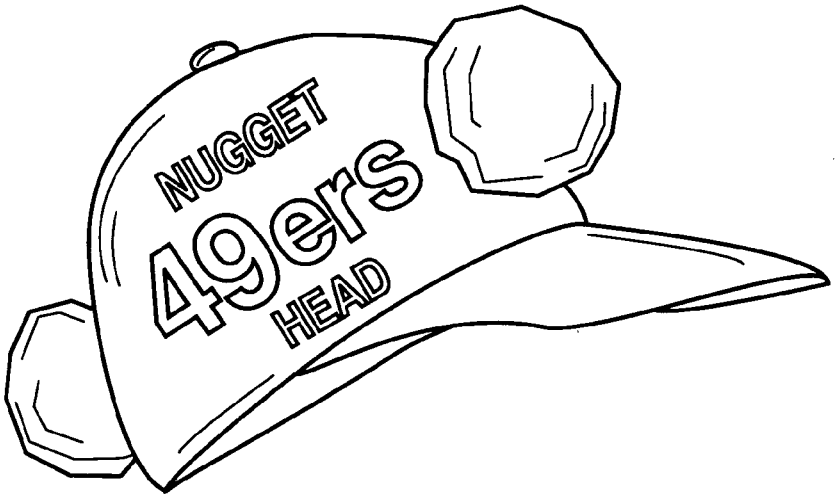
Figure 7:
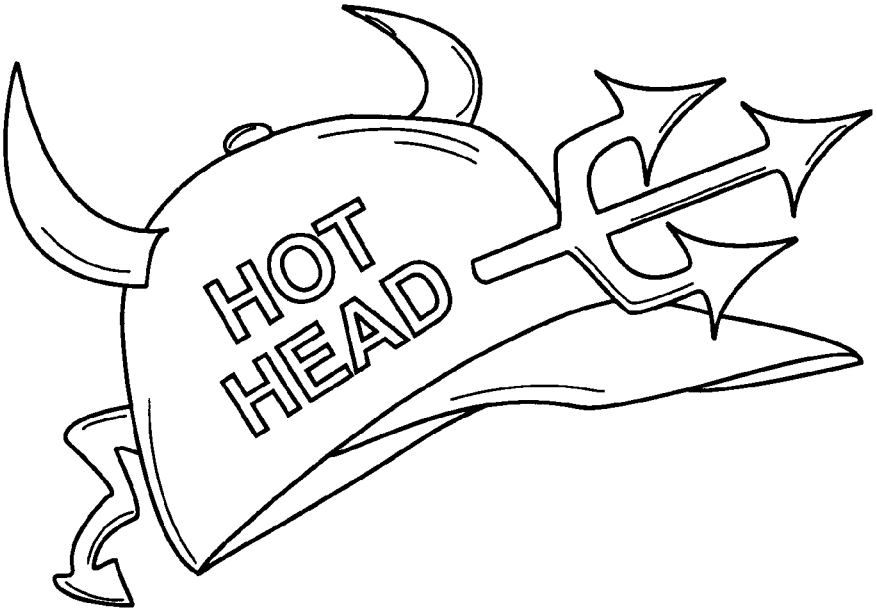

FIG. 1 shows a cap that has a crown element 10 with a rim 12, a visor 14 projecting forward from the rim 12, a button 16 at the peak of the crown element 10, and a three-dimensional configuration indicative of a sports team insignia or team name. The configuration includes a first component having a sculpted flexible form 18 enveloped in fabric 20 and secured to the crown element 10 at the base of the form 18 by a fastener 22 of engagable hooks and loops and includes a second component also having a sculpted flexible form 24 enveloped in fabric 26 and secured to the crown element 10 at the base of the form 24 by a fastener 28 of engagable hooks and loops. The fasteners 22 and 28 include a portion with a side of engaging elements but whose non-engaging side is sewn to the crown element 10 and another portion with a side of engaging elements but whose non-engaging side is adhered to the form 18 or 24 as applicable.

The forms 18 and 24 are made from a sponge-like flexible material, such as a sponge, styrofoam or soft natural lightweight plastic mold or synthetic rubber, that flexes in response to external forces applied to it. In this manner, any inadvertent contact with a solid object (such as other people) due to sudden turning of the wearer's head will not cause injury. Other types of materials that resiliently retain their shape after impact or readily absorb the external forces applied to it without creating resistance forces that could cause injury would be acceptable.

In addition, the forms 18, 24 are sculpted to provide the fundamental shape of the desired sports team insignia and positioned preferably so as to project no farther outwardly to the side than does the visor so as to minimize the risk of injury with others due to sudden movements by the wearer's head. The forms 18, 24 are then enveloped by fabric 20, 26 that is decorated to resemble the desired sports team insignia.

The engaging elements cooperate with each other and may include engaging hooks and loops, mushroom shaped connectors, interacting-article connectors, adhesives, etc.

The cap to which is applied the desired three dimensional sports team insignia is conventional, i.e., manufactured of a wool blend and/or cotton fiber with an a plastic rim that is adjusted in the back to fit various head sizes. The cap may be further decorated with the applicable sports team insignia and/or logo together with the word "head" underneath or immediately following.

In lieu of further decorating with the sports team insignia and/or logo before the word "head", some aspect of the three dimensional sports insignia on the cap may be identified (preferably in a single word) or the name of the sports team may be abbreviated, again followed by the word "head". Some examples include "JET HEAD" for the New York Jets, "SHOE HEAD" indicative of the three dimensional representation of horseshoes symbolizing the Indianapolis Colts, "HOT HEAD" for the New Jersey Devils, and "HALO HEAD" indicative of the three dimensional representation of a halo for the New Orleans Saints. Illustrative examples are found in FIGS. 2–7.

The sports team insignia may be those for professional and/or college football teams, basketball teams, soccer teams, hockey teams, and baseball teams, which are among the most popular spectator team sports in America. However, the inventive cap with three-dimensional sports team insignia has application to other spectator sports teams that may be more popular in other countries, such as rugby, cricket, polo, etc.

The fastener 22, 28 preferably has two fastener elements, one being secured such as through stitching to the crown element of the cap itself with the other fastener element being secured to either the fabric or the foam form. If secured to the flexible form (18 or 24), the fabric obviously cannot be arranged to cover it. Instead, the fabric either should border this other fastener element or be cut to form a hole to provide access to it. If applied to the fabric, the fabric should be sufficiently taut on the flexible form or otherwise secured to ensure a solid hold between the fasteners and the flexible form without allowing the flexible form to flop about at the fastener connection, as might otherwise occur due to excess slack in the fabric.

As an alternative, in lieu of using the fabric, the flexible form may be painted or otherwise decorated to provide the appropriate coloring for the sports team insignia.

The crown element 10 is a covering atop the person's head, but need not include the visor 14 or the adjustable rim 12, particularly where the crown element is a knitted ski or snow hat or the like instead of a traditional baseball cap.

While the foregoing description and drawings represent the preferred embodiments of the present invention, it will be understood that various changes and modifications may be made without departing from the spirit and scope of the present invention.

What is claimed is:

1. A sports team insignia cap, comprising:

a crown element forming a dome shape adapted to be worn atop a person's head wherein said crown element further comprises a word on said crown element that signifies a meaning selected from the group consisting of said sports team insignia, an abbreviation of said sports team insignia, and a geographical location associated with said sports team insignia;

a spongy, flexible form having a configuration indicative of said sports team insignia; and a fastener that secures said crown element and said spongy, flexible form together.

2. A cap as in claim 1, wherein said fastener includes two fastener members each having a surface with cooperating fastening elements that engage each other in response to their contact with each other, one of said two fastener members being secured to said crown element and the other being secured to said spongy, flexible form and arranged so that said cooperating fastening elements of each of said two fastener members are accessible from outside to enable their engagement in response to being brought into contact with each other.

3. A cap as in claim 1, wherein said cap has a rim, further comprising a visor extending externally from said rim by a length, said configuration projecting from said crown element to terminate at a location that defines a distance between the crown element and the location that is, at most, the same as the length of the visor.

4. A cap as in claim 1, wherein said spongy, flexible form is selected from a group consisting of a sponge, styrofoam, natural rubber and synthetic rubber.

5. A cap as in claim 1, wherein said sports team insignia include those selected from a group consisting of professional football teams, college football teams, professional soccer teams, college soccer teams, professional basketball teams, college basketball teams, professional hockey teams, college hockey teams, professional baseball teams, college baseball teams, rugby teams, cricket teams and polo teams.

6. A cap in claim 1, further comprising a fabric enveloping said spongy, flexible form and providing decoration in conformance with being indicative of said sports team insignia, said spongy, flexible form maintaining a shape of said configuration intact even in an absence of said fabric.

7. A cap as in claim 6, wherein said fastener is attached to said fabric, said fabric being taut on said spongy, flexible form, thereby enabling said fastener to secure said crown element and said spongy, flexible form together.

8. A sports team insignia cap, comprising:

a crown element forming a dome shape adapted to be worn atop a person's head wherein said crown element further comprises a first word on said crown element that signifies a meaning selected from the group consisting of said sports team insignia, an abbreviation of said sports team insignia, and a geographical location associated with said sports team insignia;

a spongy, flexible form having a configuration indicative of said sports team insignia; and a fastener that secures said crown element and said spongy, flexible form together, further comprising a second word "head" on said crown element positioned in a vicinity of said first word for reading them together as a pair of words.

9. A method of making a sports team insignia cap, comprising the steps of:

providing a crown element that has a dome shape adapted to be worn atop a person's head;

configuring a spongy, flexible form into a configuration indicative of said sports team insignia;

fastening to the crown element the spongy, flexible form after the configuring is complete; and providing a word on said crown element that signifies a meaning selected from the group consisting of said sports team insignia, an abbreviation of said sports team insignia. and a geographical location associated with said sports team insignia.

10. A method as in claim 9, wherein the configuring includes configuring the spongy, flexible form into at least two components that cooperate in constituting said configuration, securing each of said at least two components to different locations of said crown element and spacing the at least two components apart from each other so that a space between said at least two components is free of said configuration.

11. A method as in claim 9, further comprising the step of adding a further word "head" on said crown element positioned in a vicinity of the first-mentioned word for reading them together as a pair of words.

* * * * *